US010655834B1

(12) United States Patent
Kotovsky

(10) Patent No.: US 10,655,834 B1
(45) Date of Patent: May 19, 2020

(54) LIGHTING APPARATUS WITH SCREENS AND METHOD

(71) Applicant: Irwin Kotovsky, Pittsburgh, PA (US)

(72) Inventor: Irwin Kotovsky, Pittsburgh, PA (US)

(73) Assignee: Irwin Kotovsky, Pittsburgh, PA (US)

( * ) Notice: Subject to any disclaimer, the term of this patent is extended or adjusted under 35 U.S.C. 154(b) by 0 days.

(21) Appl. No.: 16/294,533

(22) Filed: Mar. 6, 2019

(51) Int. Cl.

| | |
|---|---|
| ***F21V 29/503*** | (2015.01) |
| ***F21V 29/70*** | (2015.01) |
| ***F21V 17/02*** | (2006.01) |
| ***F21V 14/04*** | (2006.01) |
| ***F21V 19/00*** | (2006.01) |
| ***H05B 47/185*** | (2020.01) |

(52) U.S. Cl.
CPC ..... *F21V 29/503* (2015.01); *F21V 14/04* (2013.01); *F21V 17/02* (2013.01); *F21V 19/003* (2013.01); *F21V 19/0015* (2013.01); *F21V 29/70* (2015.01); *H05B 47/185* (2020.01)

(58) Field of Classification Search
CPC ..... F21V 29/503; F21V 29/70; F21V 17/02; F21V 14/006; F21V 14/04; F21V 14/06
See application file for complete search history.

(56) References Cited

U.S. PATENT DOCUMENTS

| | | | | |
|---|---|---|---|---|
| 5,550,725 | A * | 8/1996 | Shemitz | F21V 17/02 362/147 |
| 10,101,007 | B1 * | 10/2018 | Antriasian | F21V 7/0025 |
| 2011/0043132 | A1 * | 2/2011 | Kim | F21S 8/026 315/294 |
| 2013/0343048 | A1 * | 12/2013 | Dumont | F21V 7/00 362/217.07 |
| 2015/0138829 | A1 * | 5/2015 | Jang | G02B 6/0016 362/606 |

* cited by examiner

*Primary Examiner* — Alan B Cariaso
(74) *Attorney, Agent, or Firm* — Ansel M. Schwartz

(57) ABSTRACT

A lighting apparatus for a building structure. The apparatus includes a plurality of LEDs and a holder having a heat sink for holding the LEDs along a length of the holder and dissipating heat from the LEDs. The apparatus includes a first bracket which extends outward from the holder in a first direction on a first side of the holder and is moveably attached to the holder. The apparatus includes a second bracket which extends outward from the holder in a second direction on a second side of the holder and is moveably attached to the holder. The apparatus includes a first screen attached to the first bracket on the first side of the holder and a second screen attached to the second bracket on the second side of the holder. When the first bracket is moved, the first screen is moved relative to the holder on the first side of the holder; and when the second bracket is moved, the second screen is moved relative to the holder on the second side of the holder. A method for lighting a building structure.

15 Claims, 10 Drawing Sheets

LIGHTING APPARATUS WITH SCREENS AND METHOD

FIELD OF THE INVENTION

The present invention is related to lighting apparatuses that utilize reflectors. (As used herein, references to the "present invention" or "invention" relate to exemplary embodiments and not necessarily to every embodiment encompassed by the appended claims.) More specifically, the present invention is related to lighting apparatuses that utilize reflectors with LEDs or lasers.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

Indirect light is a pleasing manner of providing the light required for various tasks. With indirect light, less foot-candles (quantity of light) is required to provide the same illumination levels as with direct light. Reflectors redirect light to create indirect light.

With the advent of LEDs and lasers as sources of light, a multitude of additional lighting designs with reflectors are possible. In most such designs, the heat produced by the LEDs and lasers needs to be properly dissipated so the LEDs or lasers are not damaged.

BRIEF SUMMARY OF THE INVENTION

The present invention pertains to a lighting apparatus for a building structure. The apparatus comprises a plurality of LEDs. The apparatus comprises a holder having a heat sink for holding the plurality of LEDs along a length of the holder and dissipating heat from the LEDs. The apparatus comprises an attachment connected to the holder to hold the holder to the building structure. The apparatus comprises a first bracket which extends outward from the holder in a first direction on a first side of the holder and is moveably attached to the holder. The apparatus comprises a second bracket which extends outward from the holder in a second direction on a second side of the holder and is moveably attached to the holder. The apparatus comprises a first screen attached to the first bracket on the first side of the holder and a second screen attached to the second bracket on the second side of the holder. When the first bracket is moved, the first screen is moved relative to the holder on the first side of the holder, and when the second bracket is moved, the second screen is moved relative to the holder on the second side of the holder.

The present invention pertains to a method for lighting a building structure. The method comprises the steps of moving a first bracket, attached to a first screen and moveably attached to a first side of a holder, relative to the holder so the first screen is placed into a desired position relative to a first row of LEDs attached to the first side of the holder. The first bracket extends outward from the holder in a first direction on the first side of the holder. There is the step of moving a second bracket attached to a second screen and moveably attached to a second side of a holder relative to the holder so the second screen is placed into a desired position relative to a second row of LEDs attached to the second side of the holder. The second bracket extends outward from the holder in a second direction on the second side of the holder. The holder having a heat sink for holding the first row of LEDs and second row of LEDs along a length of the holder and dissipating heat from the LEDs. The holder held by an attachment connected to the holder to the building structure.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
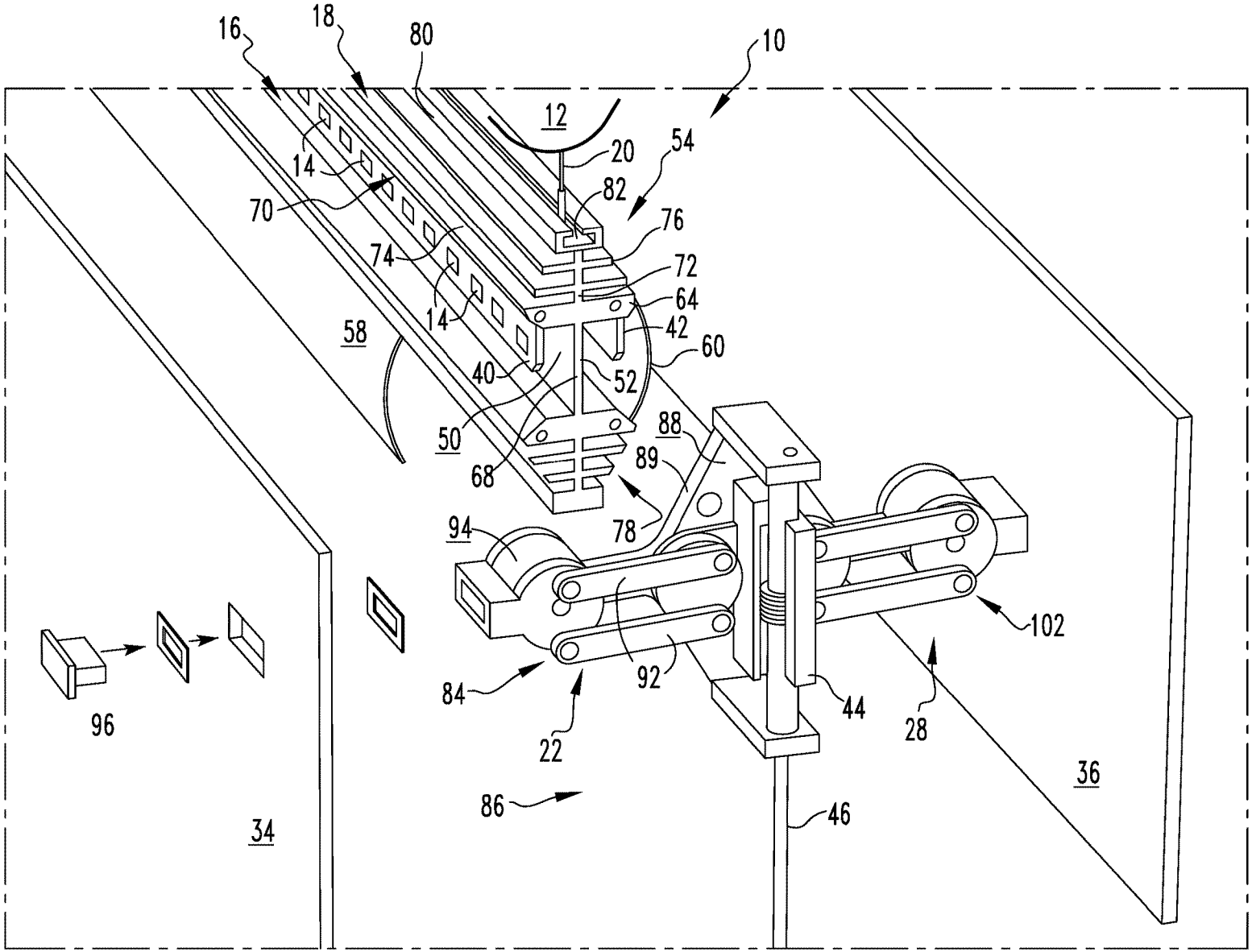
FIG. 1 is an assembly view of a portion of the lighting apparatus of the present invention.

Referring now to the drawings wherein like reference numerals refer to similar or identical parts throughout the several views, and more specifically to FIGS. 1-4 thereof, there is shown a lighting apparatus 10 for a building structure 12. The apparatus 10 comprises a plurality of LEDs 14. The apparatus comprises a holder 16 having a heat sink 18 for holding the plurality of LEDs 14 along a length of the holder 16 and dissipating heat from the LEDs 14. The apparatus comprises an attachment 20 connected to the holder 16 to hold the holder 16 to the building structure 12. The apparatus comprises a first bracket 22 which extends outward from the holder 16 in a first direction 24 on a first side 26 of the holder 16 and is moveably attached to the holder 16. The apparatus comprises a second bracket 28 which extends outward from the holder 16 in a second direction 30 on a second side 32 of the holder 16 and is moveably attached to the holder 16. The apparatus comprises a first screen 34 attached to the first bracket 22 on the first side 26 of the holder 16 and a second screen 36 attached to the second bracket 28 on the second side 32 of the holder 16. When the first bracket 22 is moved, the first screen 34 is moved relative to the holder 16 on the first side 26 of the holder 16; and when the second bracket 28 is moved, the second screen 36 is moved relative to the holder 16 on the second side 32 of the holder 16.

The apparatus may include a power cord 38 attached to the holder 16 and in electrical communication with the LEDs 14 to provide electricity to the LEDs 14. The first bracket 22 and second bracket 28 may rotate relative to the holder 16 so the first screen 34 and second screen 36 can be positioned in contact above the holder 16 to reflect light from the LEDs 14 downward or can be positioned in contact below the holder 16 to reflect light from the LEDs 14 upward or can be positioned anywhere between above and below the holder 16. The first screen 34 and the second screen 36 may extend the length of the holder 16 and each may be one continuous piece. The LEDs 14 may be disposed in a first row 40 along the length of the holder 16 and operate at between 1500 degrees Kelvin and 10000 degrees Kelvin. The lighting apparatus 10 may include a second row 42 of LEDs 14 in parallel with the first row 40, as shown in FIG. 7.

Figure 5:
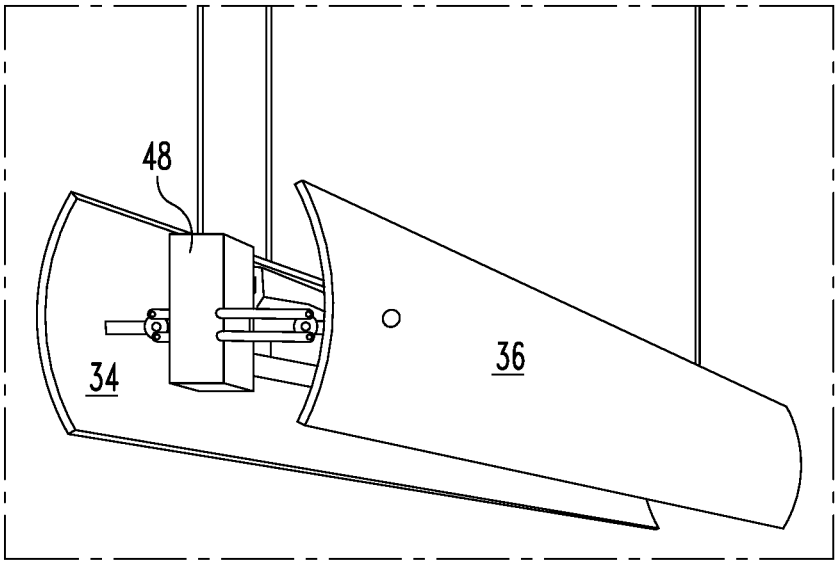
FIG. 5 is a perspective view of the lighting apparatus in a combination position, motorized with a motor inside the first and second screens.
Figure 6:
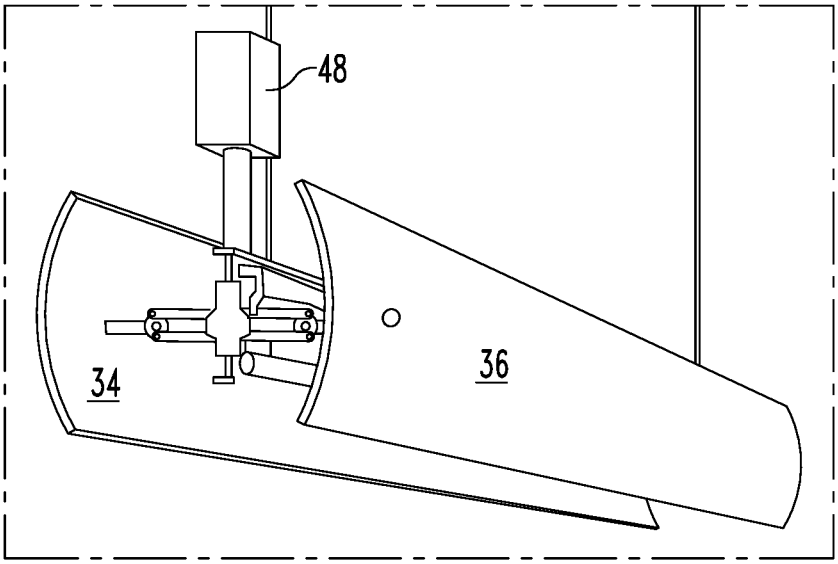
FIG. 6 is a perspective view of the lighting apparatus in a combination position motorized with the motor outside the first and second screens.

The lighting apparatus 10 may include a gear assembly 44 engaged with the first and second brackets 22, 28, as shown in FIG. 1. When the gear assembly 44 moves, the first and second screens 34, 36 rotate about the holder 16. The lighting apparatus 10 may include a stem 46 which extends down from the gear assembly 44. When the stem 46 is rotated, the stem 46 moves the gear assembly 44 which rotates the first and second screens 34, 36 about the holder 16. The lighting apparatus 10 may include a motor 48 engaged with the gear assembly 44. When the motor 48 is activated, the motor 48 moves the gear assembly 44 which rotates the first and second screens 34, 36 about the holder 16. FIG. 5 is a perspective view of the lighting apparatus 10 in a combination position, motorized with a motor 48 inside the first and second screens 34, 36. FIG. 6 is a perspective view of the lighting apparatus 10 in a combination position motorized with the motor 48 outside the first and second screens 34, 36.

Figure 7:
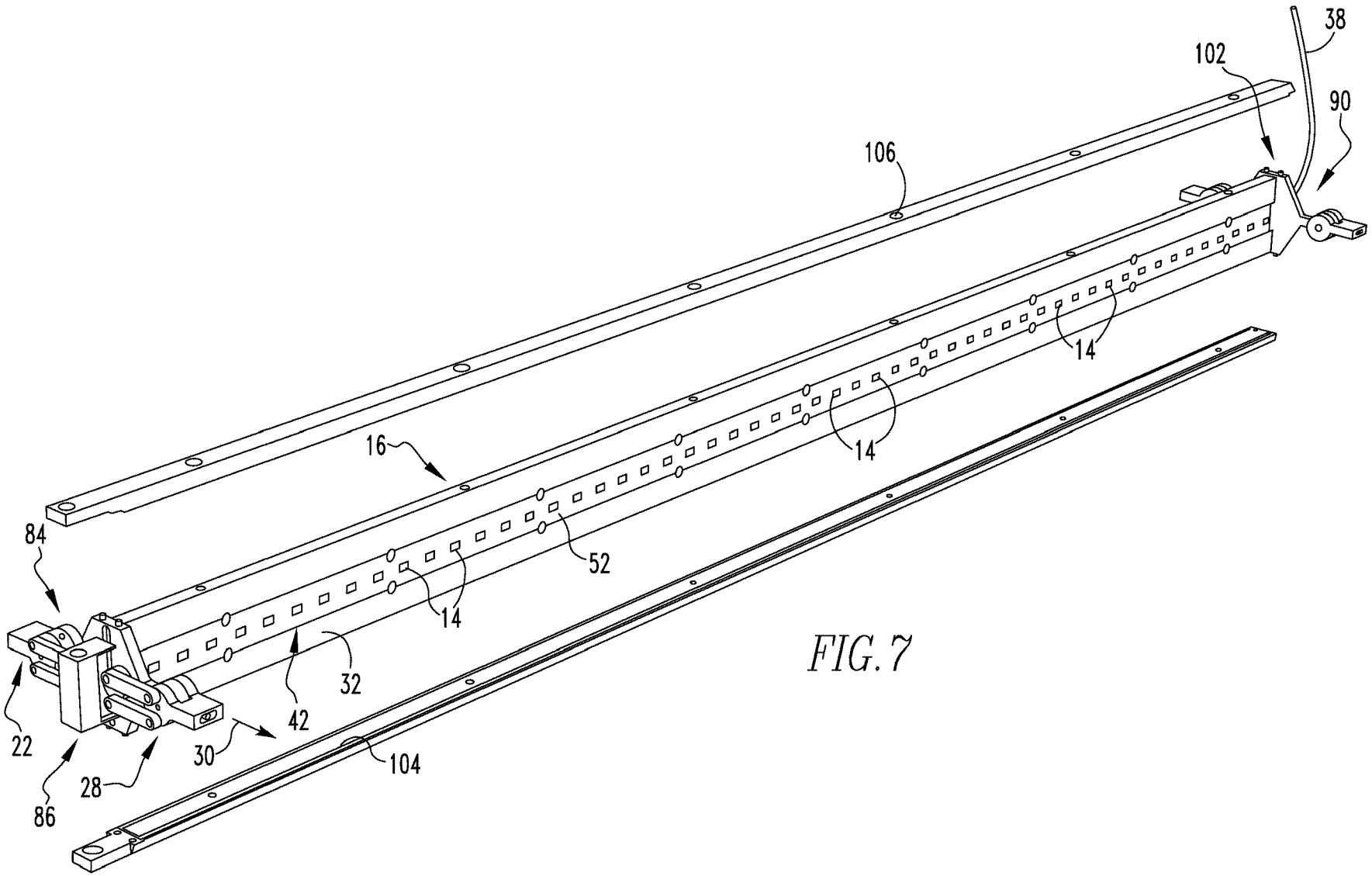
FIG. 7 is a perspective view of the lighting apparatus with the first and second screens removed.
Figure 8:
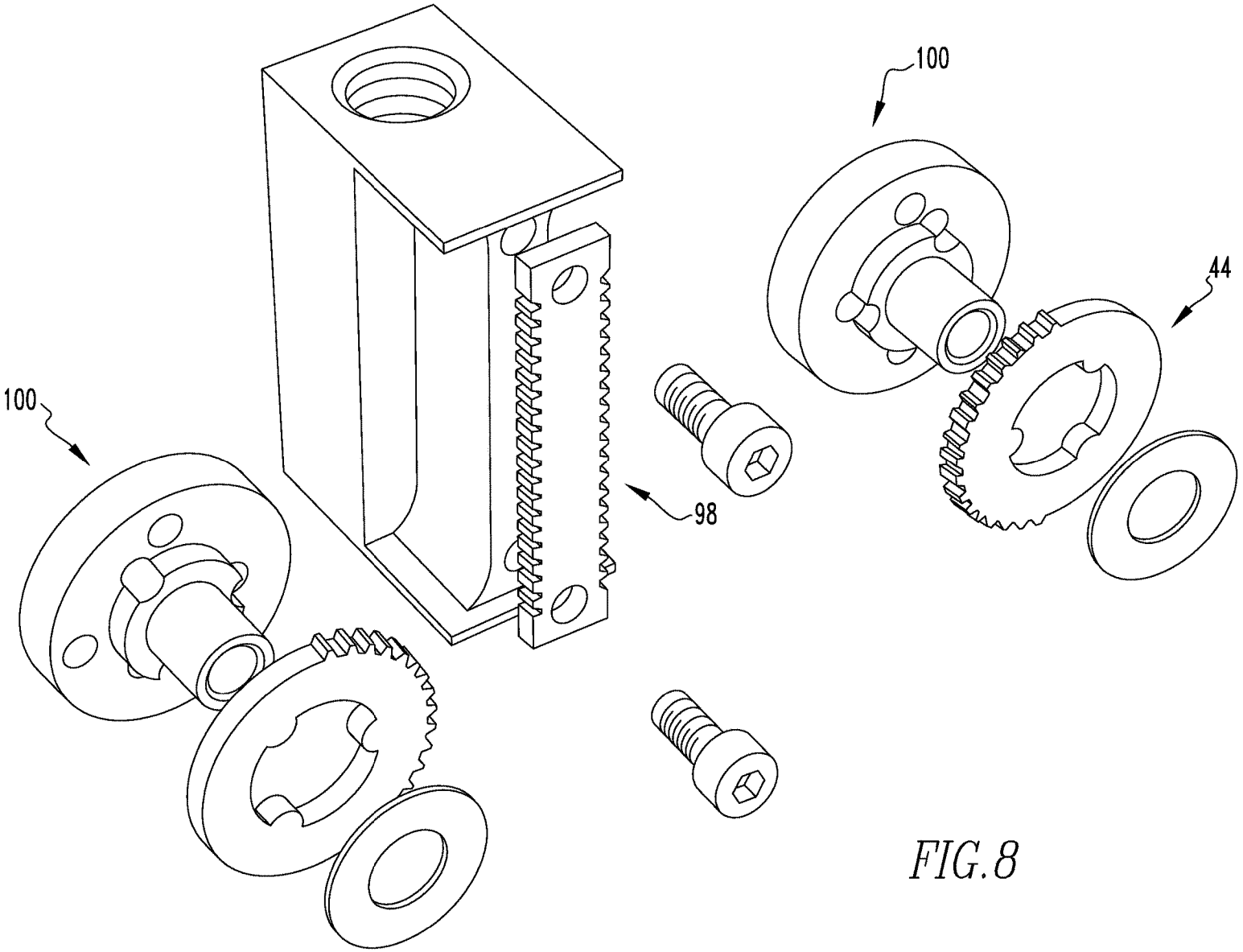
FIG. 8 shows the rack and pinion mechanism and the gear wheels of the first mechanical element.
Figure 9:
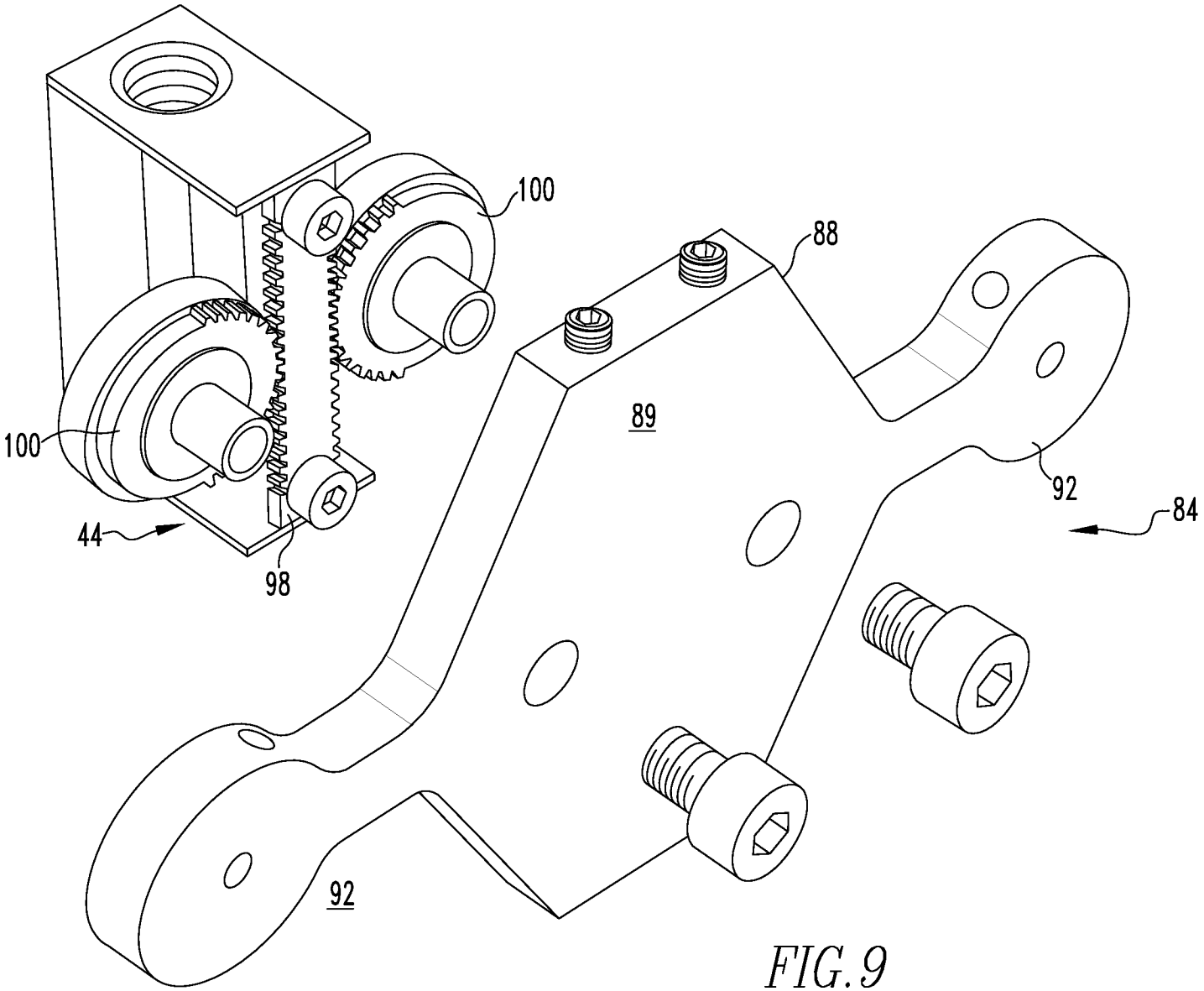
FIG. 9 shows the housing, rack and pinion mechanism, and the gear wheels of the first mechanical element.
Figure 10:
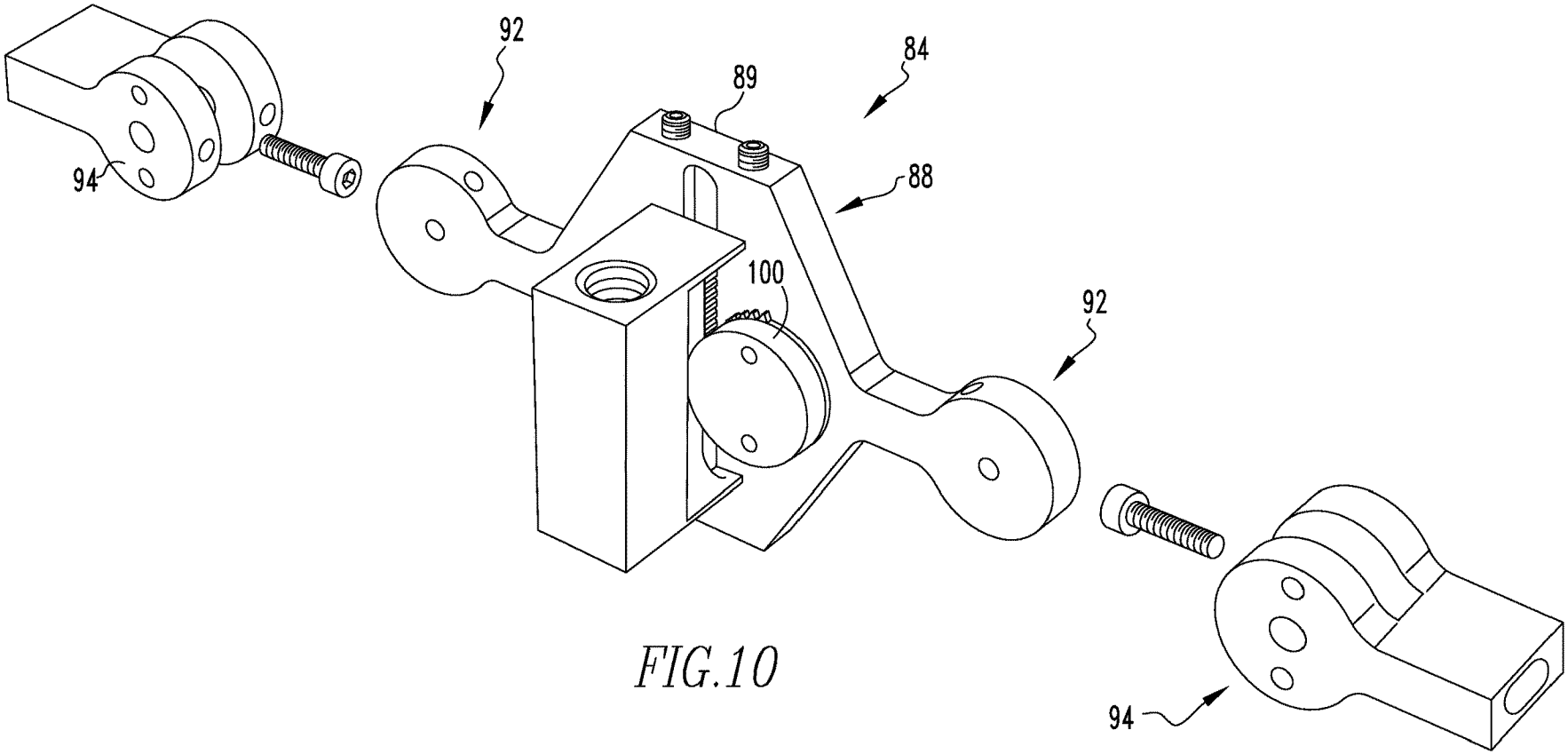
FIG. 10 shows an assembly drawing of the gear assembly with the first mechanical element.
Figure 11:
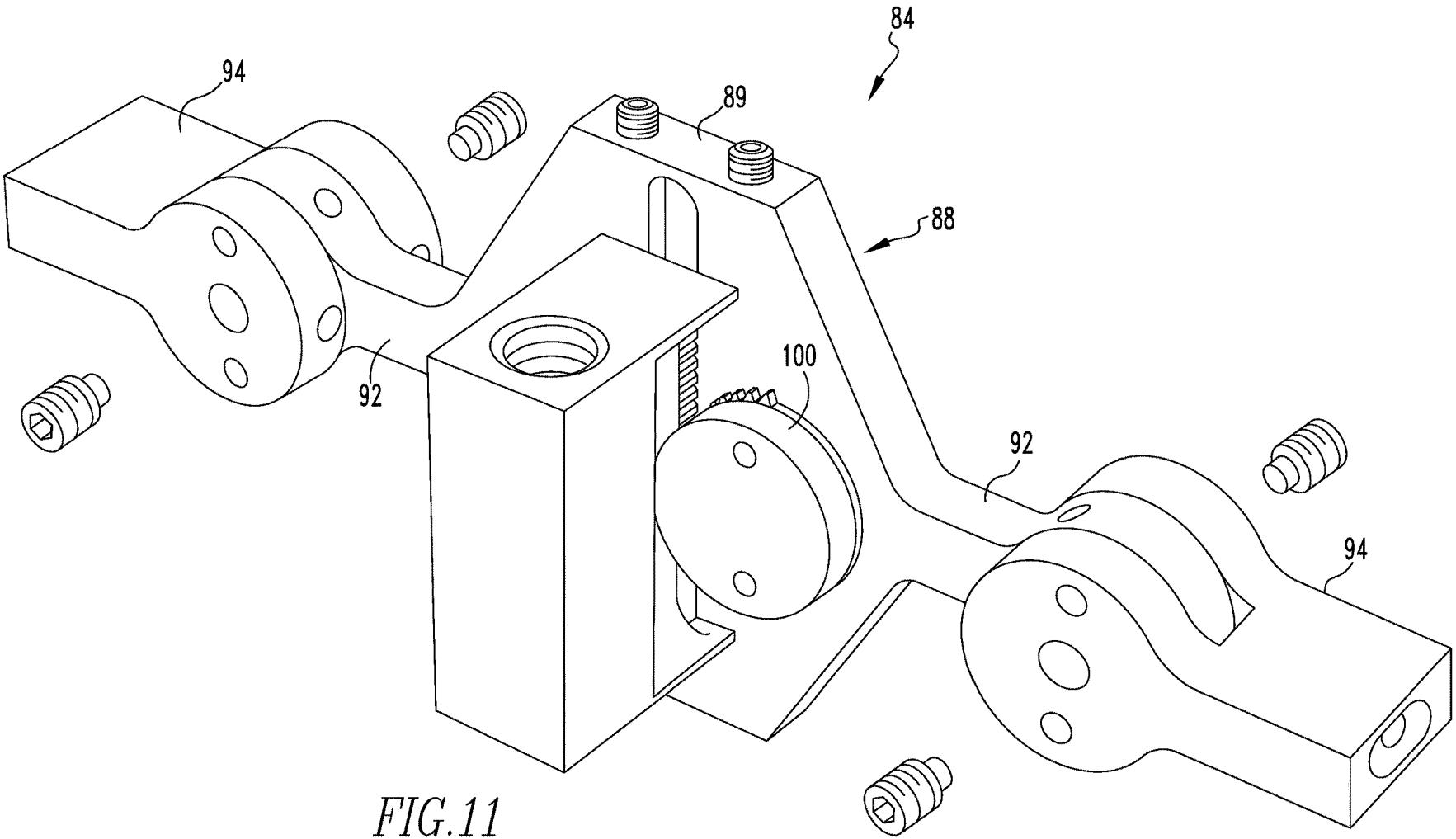
FIG. 11 shows the gear assembly with the first mechanical element.
Figure 13:
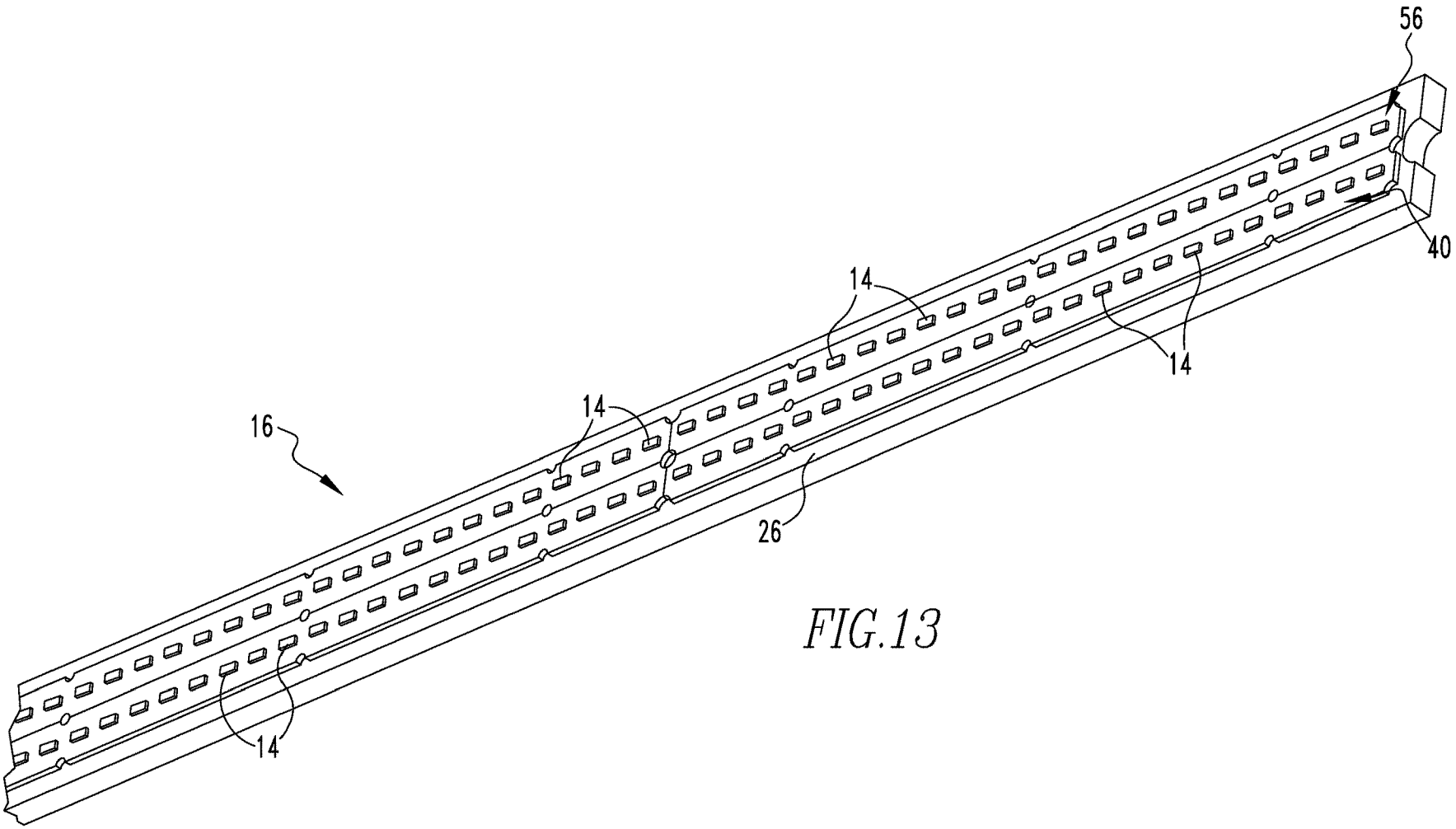
FIG. 13 shows a holder with one row of LEDs on top of another row of LEDs.

As shown in FIGS. 1 and 7, the holder 16 may have a first slot 50 extending along the length of the holder 16 with the first row 40 of LEDs 14 disposed in the first slot 50 on the first side 26 of the holder 16 emanating light out from the first side 26, and a second slot 52 extending along the length of the holder 16 with the second row 42 of LEDs 14 disposed in the second slot 52 on the second side 32 of the holder 16 emanating light out from the second side 32. The heat sink 18 may include a plurality of fins 54 disposed above the first and second slots 50, 52 extending along the length of the holder 16. The lighting apparatus 10 may include a third row 56 of LEDs 14 disposed on the first side 26 of the holder 16 above the first row 40 of LEDs 14, as shown in FIG. 13, emanating light out from the first side 26 which operate at a temperature at least 500 degrees Kelvin different from a temperature at which the first row 40 of LEDs 14 operate.

The first screen 34 and the second screen 36 may be opaque, reflective to reflect light from the first row 40 of LEDs 14, translucent to reflect some light and transmit some light from the first row 40 of LEDs 14, or transparent to transmit light from the first row 40 of LEDs 14, or combinations thereof. Logos or names or text may be written on the first screen 34 or the second screen 36. The lighting apparatus 10 may include a first diffuser 58 extending along the length of the holder 16 attached to the holder 16 about the first slot 50 to cover the first row 40 of LEDs 14 through which light from the first row 40 of LEDs 14 is transmitted, as shown in FIG. 1, and a second diffuser 60 extending along the length of the holder 16 attached to the holder 16 about the second slot 52 to cover the second row 42 of LEDs 14 through which light from the second row 42 of LEDs 14 is transmitted.

In the operation of the invention, the screens and diffusers of the lighting apparatus 10 can be straight sided, multisided or curved. If they are curved, they can be in one or two or in multiple directions. The screens and diffusers can be fabricated from metal, steel, aluminum, brass, copper, fabric, alloys and/or wood, or combinations thereof, and may be finished by plating or painting. The individual materials may be of different densities so as to allow different levels of light to pass through depending on the density of the material. For instance, if fabric is used for the screen or diffuser, a less dense threading portion of the fabric may be next to a more dense threading portion of fabric, so more light will be transmitted through the less dense threading portion of fabric than the more dense threading portion of fabric. The screens and diffusers can have inserts of glass or plastic so that portions of the screens and diffusers block light from the LEDs 14 or reflect light from the LEDs 14 while other portions that have inserts of glass or plastic transmit light through the inserts. The screens can be made of two or more strips of material, for instance with the top or bottom portion being of a reflective material and the other portion being of a transparent or translucent material. Alternatively, there can be spaces between the strips so that the top portion and a bottom portion can be of a reflective material, while light transmits through the space between the strips. Alternatively, instead of a space between the top and bottom reflective portions, there can be a translucent or transparent strip through which light transmits, where the translucent or transparent strip is clear, or is colored to cover the light emitted from the LEDs 14 for his multiple colored.

If the reflectors or diffusers are made of glass, the glass can be clear, prismatic, reflective, translucent or transparent or a combination thereof. The reflectors and diffusers can have lenses which provide directional or angular patterns of light emitted from the LEDs 14. The lenses may be placed in front of a given LED so the light emitted by the LED is transmitted through the lens and caused to bend or spread or be directed or be dispersed as desired based on the type of lens.

The screens may be adjusted manually, such as with stems 46, as shown in FIG. 1, or with motors 48, as shown in FIGS. 5 and 6, that are controlled remotely with a dedicated remote control, or an application on a smart phone. Furthermore, the smart phone with the application or the remote control can change the lighting emitted by the LEDs 14 by controlling the electricity powering the LEDs 14 and the temperature at which the LEDs 14 are operating.

Figure 4:
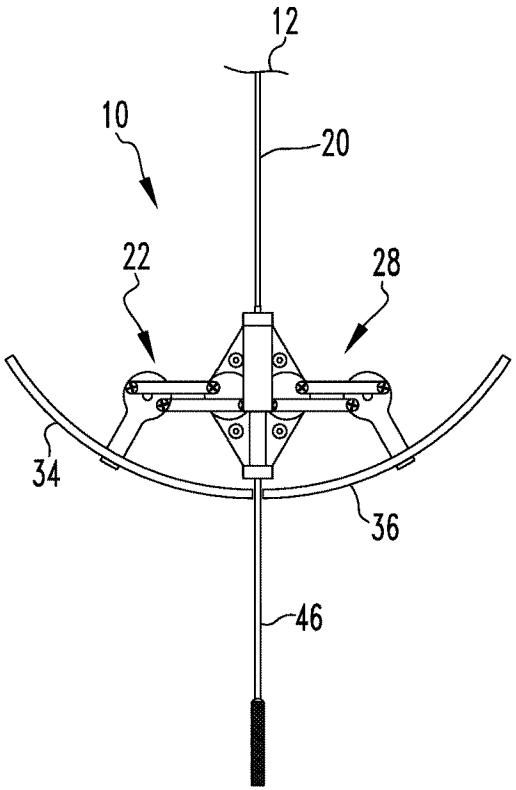
FIG. 4 is a front view of the lighting apparatus in an up lighting position.
Figure 3:
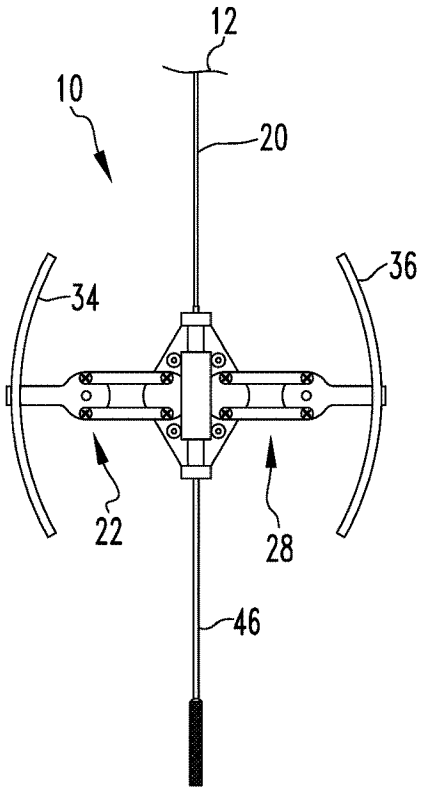
FIG. 3 is a front view of the lighting apparatus in a combination lighting position.
Figure 2:
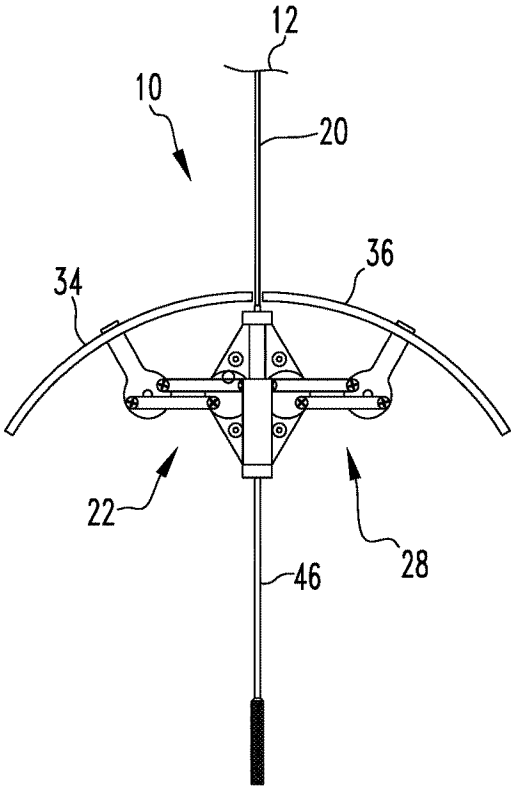
FIG. 2 is a front view of the lighting apparatus in a down lighting position.

The screens can be positioned to provide up light where the first and second screens 34, 36 are positioned below the holder 16 and reflect light from the LEDs 14 upwards, as shown in FIG. 4. The screens can be positioned to provide down light where the first and second screens 34, 36 are positioned above the holder 16 and reflect light from the LEDs 14 downwards, as shown in FIG. 2. Additionally, the first and second screens 34, 36 can be in a combination position where the first and second screens 34, 36 are along the sides of the holder 16 to reflect light towards the sides of the holder 16, or at various positions between the uppermost position or the lowermost position to provide a combination of up and down light. By adjusting the position of the screens, the exact desired beam pattern emitted by the LEDs 14 can be attained.

The source of illumination may be LEDs 14 or lasers. The LEDs 14 or lasers may be in a linear single row or multiple rows, with one row of LEDs 14 for lasers on top of and in parallel with another row. The LEDs 14 or lasers in a linear single row are positioned alongside each other in series and are all connected to the power source that extends along the length of the holder 16. The LEDs 14 in a single row may be in one continuous strip through which powerlines run power to the LEDs 14. The LEDs 14 can vary in Kelvin temperature from between 1500 to 10,000 Kelvin. Preferably, the LEDs 14 operate between 3000 K and 6000 K, and if more than one row of LEDs 14 are used, each of the rows of LEDs 14 can operate at a different temperature, preferably at least 500 Kelvin difference between them to provide different color lighting. The color rendering index (CRI) of the LEDs 14 may be as high as 98.5.

The holder 16 may be suspended with rods, tubes, cables, cord, chain links, rope and/or wire. Power can be supplied by normal wiring in 12 V, 24 V, 120 V, 240 V and/or 277 V. The building structure can be a room in an office or residence or a patio. Basically, a building structure is any type of structure in which people may be present.

A wall-mounted version of the lighting apparatus 10 has one side of the holder 16 mounted directly to a wall, with only one screen, or with two screens on the same side of the holder 16. In this case one screen would be angled upwards while the other screen would be angled downwards on the same side of the holder 16. Alternatively, a mounting extends from the wall and holds the lighting apparatus 10 as described above in the same way as a lighting apparatus 10 hangs from the ceiling, except here, the lighting apparatus 10 hangs from the mounting extending from the wall.

The basic idea of the lighting apparatus 10 is to apply one or more independent screens, close to the LEDs 14, in a holder 16. These screens (that act as reflectors) can be changed in position so that the light is changed together with the appearance of the fixture. For example, it is possible to change the light from uplight to downlight, by rotating the screens around the holder 16. A wall fixture or a cornice may also be provided, with a top half that can take two positions: uplight when the top half is flush with the lower half, or indirect forward-light whet the top half is tilted backwards over 30 degrees. Or, it is also possible to make a screen that is composed of two halves, that opens in the middle to add a portion of direct light. Movement of the screens is preferably motor-controlled, at least for all lighting apparatus 10 beyond reach, although it does not have to be.

The lighting apparatus 10 has the following characteristics: the ability to influence the lighting apparatus 10' lighting effect by a changement in the shape of the lighting apparatus 10. This changement in shape adds greatly to the aesthetic quality of the lighting apparatus 10, and the lighting apparatus 10 looks strikingly different when two positions are being compared. The changement in form is the result of the movement of one or more screens. This movement can be linear or rotative; it can be done manually or by one or more motors 48. The number of different positions ('appearances') can be limited to 2, 3, or 4, so that the difference between the positions remains a dominant characteristic.

The screens cover the full length of the holder 16. The first and second screens 34, 36 may also be used for a linear movement. The lighting apparatus 10 range may be extended with sliding doors instead of rotating screens. The first screen 34 and second screen 36 are attached to the first and second rotating brackets, respectively, in such a way that they can easily be replaced by screens of a different type or finish, for instance, translucent polycarbonate, for different lighting effects.

The holder 16 is preferably an aluminum extrusion whose center has a cross-section essentially of an I with a flat rectangular top 64 and a flat rectangular bottom 66 opposing the top 64, with a center plate 68 extending perpendicularly down from the middle of the top 64 and extending perpendicularly up from the middle of the bottom 66, as shown in FIG. 1. The first slot 50 is defined on the first side 26 of the center plate 68 between the top 64 and the bottom 66, which extend toward the first side 26 from the center plate 68. The second slot 52 is defined on the second side 32 of the center plate 68 between the top 64 and the bottom 66, which extend toward the second side 32 from the center plate 68.

Extending perpendicularly up from the middle of the top 64 is a first heat sink structure 70 comprising second plate 72 with a first layer 74 of fins 54 extending perpendicularly to the first side 26 and perpendicularly to the second side 32 and in spaced relation with the top 64; and a second layer 76 of fins 54 extending perpendicularly to the first side 26 and perpendicularly to the second side 32 and in spaced relation and above the first layer 74 of fins 54. By the first row 40 of LEDs 14 being disposed in the first slot 50 and in contact with the aluminum center plate 68 and the second row 42 of LEDs 14 being disposed in the second slot 52 and in contact with the aluminum center plate 68 provides for a path for heat from the LEDs 14 to travel through the center plate 68 and the top 64 to the second plate 72 and to the first layer 74 of fins 54 and the second layer 76 of fins 54. The surface area of the first layer 74 of fins 54 and second layer 76 of fins 54 allows heat in the first layer 74 of fins 54 and second layer 76 of fins 54 to dissipate into the air to keep the LEDs 14 from overheating. An identical second heat sink structure 78 extends perpendicularly down from the middle of the bottom 66, so heat from the LEDs 14 can also travel downwards to be dissipated. A third layer 80 with a groove 82, positioned above the second layer 76 of fins 54 can extend from the second plate 72. The groove 82 can receive the attachment 20 to hold the apparatus to the building structure 12. A cover 104 can be positioned over the bottom of the holder and a lid 106 can be placed over the third layer 80.

A first diffuser 58 can be positioned over the first slot 50 by extending from the top 64 on the first side 26 to the bottom 66 on the first side 26. A second diffuser 60 can be positioned over the second slot 52 by extending from the top 64 on the second side 32 to the bottom 66 on the second side 32.

A first mechanical element 84, as shown in FIGS. 1 and 7-11, is attached to the front 86 of the holder 16, through which the first screen 34 and second screen 36 are moved. The first mechanical element 84 has a housing 88 with a back 89 that fits over the front 86 of the holder 16 to close the first slot 50 and the second slot 52 and cover the first heat sink structure 70 and the second heat sink structure 78. The first mechanical element 84 has a gear assembly 44 that facilitates the movement of the first screen 34 and second screen 36. Extending from the housing 88 on either side are the first and second brackets. Each bracket has a pushrod 92 that extends from the gear assembly 44, and an interface 94 at the end of the pushrod 92 to attach to the respective screen. The pushrods 92 serve to support the screens in a spaced relationship apart from the holder 16. The interfaces 94 on the pushrods 92 receive aluminum plugs 96 that fit to and hold the screens to the interfaces 94. The pushrods 92 are connected to a rack and pinion mechanism 98 of the gear assembly 44, which when moved, causes a symmetrical and simultaneous rotative movement of two gear-wheels 100, which in turn causes the interfaces 94 to rotate about the pushrods 92 and rotate the first and second screens 34, 36.

If the screens are moved manually, a stem 46 extends down from the housing 88 and engages the rack and pinion mechanism 98. By rotating the stem 46, the rack and pinion mechanism 98 is moved, causing the interfaces 94 to move and thus the screens attached to the interfaces 94 to move.

If a motor 48 is used to move the first and second screens 34, 36, the first mechanical element 84 has a remote-controlled geared miniature motor 48 in the center that causes a worm-wheel to spin. The spinning movement is transmitted to the symmetrical and simultaneous rotative movement of the two gear-wheels 100, through the rack and pinion mechanism 98, which is turned by the spinning worm-wheel that engages it. The rack and pinion mechanism 98 then moves the first and second screens 34, 36 as described above for the manual operation.

The motor 48 may have micro-switches that prompt the movement to stop in a certain position. The first stop can be associated with the first and second screens 34, 36 in the up lighting position, a second stop can be associated with the first and second screens 34, 36 in the down lighting position, and a third stop can be associated with the first and second screens 34, 36 in the combination position at the sides of the holder 16 opposing each other.

The first stop or position is when the screens close themselves around the holder 16 at the bottom 66 side of holder 16. This way, essentially no direct light from the LEDs 14 can reach the floor; all this light is reflected upwards by the screens, that, for instance, have a sheet of specular aluminum at their inside.

The second stop or position is when the screens are rotated above the holder 16. This way, an inverse effect is obtained: all the light is being reflected downwards. Only in this position, if desired, the first screen 34 and second screen 36 are still 5 cm (2 in.) apart, so that a small amount of uptight still reaches the ceiling.

The third position (automatic stop), is where there is an equal amount of uplight and downlight, and practically no side-light. This effect is obtained when the first screen 34 and second screen 36 are in a position symmetrical to the holder 16. This position can alternatively be obtained by pressing the 'stop' button on the remote control at a certain moment when the first screen 34 and second screen 36 are moving from one position to the other.

Figure 12:
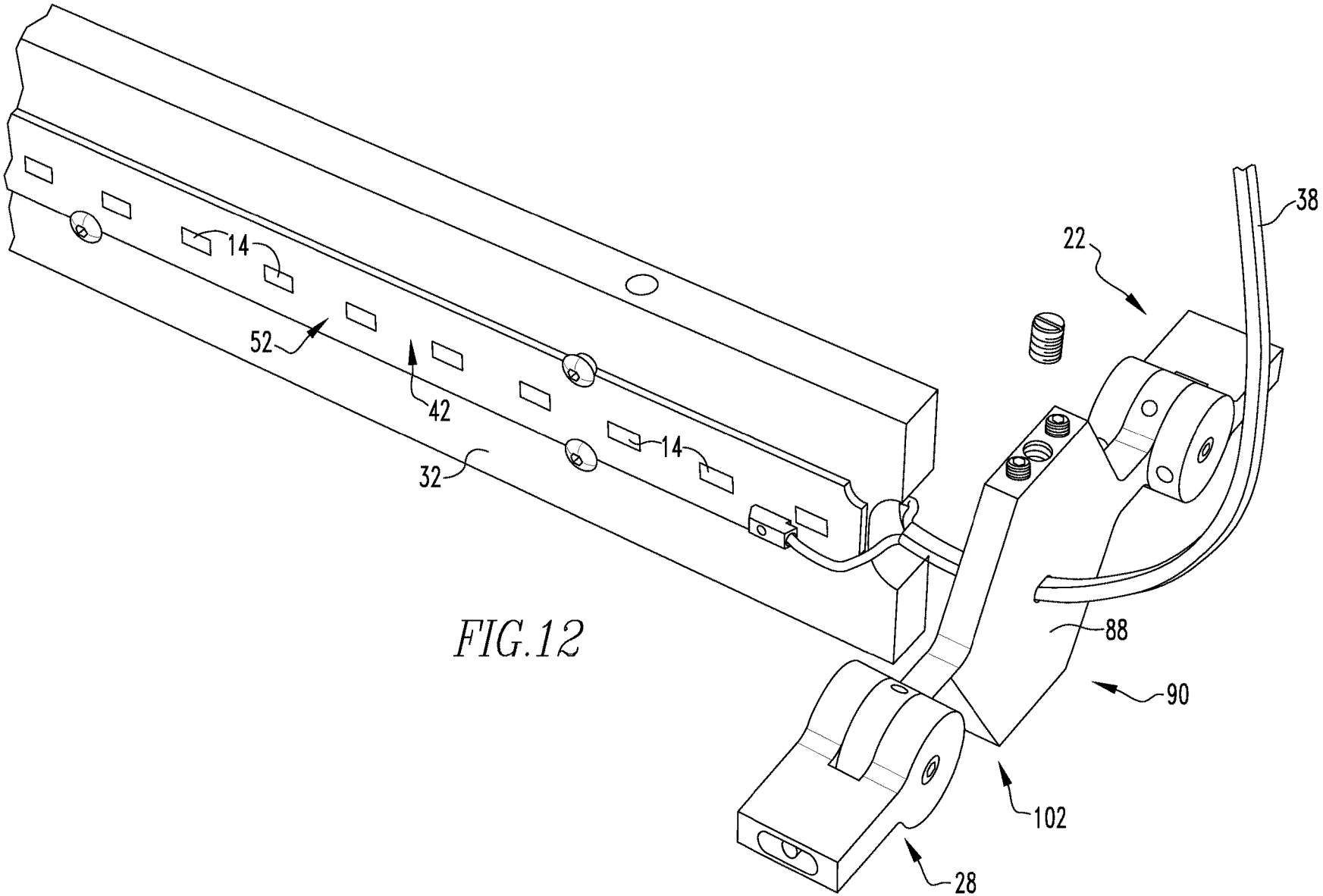
FIG. 12 shows the second mechanical element.

A second mechanical element 102, as shown in FIG. 12 is attached to the rear 90 of the holder 16, through which the power cord 38 is attached to the holder 16 and thus the LEDs 14. The second mechanical element 102 is the same shape and design as the first mechanical element 84 and attaches to the first and second screens 34, 36 in the same way as the first mechanical element 84 attaches to the first and second screens 34, 36, with brackets so the second mechanical element 102 supports and allows the first and second screens 34, 36 to move when the first mechanical element 84 moves the first and second screens 34, 36. However, the second mechanical element 102 does not have any ability to apply a force to the first and second screens 34, 36, like the first mechanical element 84 does. The second mechanical element 102 does not have a rack and pinion mechanism 98 nor gear wheels, not a motor 48, nor a stem 46.

Similarly, as shown in FIG. 5 with the motor 48 inside the panels, or as shown in FIG. 6 with the motor 48 outside the panels, a worm gear in the motor 48 engages with the rack and pinion mechanism 98, causing the rack and pinion mechanism 98 to move, which causes the interfaces 94 to move and thus the screens attached to the interfaces 94 to move.

In place of, or interspersed with the LEDs 14 in the rows, may be lasers. The lasers would receive power from the same power cord and connected to the same power strip as the LEDs that the lasers replace in this embodiment. The lasers could each be mounted to the holder 16 at a desired angle to emit light at that angle. Diffusers or lenses may be placed in front of the lasers to control the dispersion of the light and the form of the beam of light generated by each laser.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A lighting apparatus for a building structure comprising:

a plurality of LEDs;

a holder having a heat sink for holding the plurality of LEDs along a length of the holder and dissipating heat from the LEDs;

an attachment connected to the holder to hold the holder to the building structure;

a first bracket which extends outward from the holder in a first direction on a first side of the holder and is moveably attached to the holder;

a second bracket which extends outward from the holder in a second direction on a second side of the holder and is moveably attached to the holder; and a first screen attached to the first bracket on the first side of the holder and a second screen attached to the second bracket on the second side of the holder, when the first bracket is moved, the first screen is moved relative to the holder on the first side of the holder, and when the second bracket is moved, the second screen is moved relative to the holder on the second side of the holder.

2. The lighting apparatus of claim 1 includes a power cord attached to the holder and in electrical communication with the LEDs to provide electricity to the LEDs.

3. The lighting apparatus of claim 2 wherein the first bracket and second bracket rotate relative to the holder so the first screen and second screen can be positioned adjacent each other above the holder to reflect light from the LEDs downward or can be positioned in contact below the holder to reflect light from the LEDs upward or can be positioned anywhere between above and below the holder.

4. The lighting apparatus of claim 3 wherein the first screen and the second screen extend the length of the holder.

5. The lighting apparatus of claim 4 wherein the LEDs are disposed in a first row along the length of the holder and operate at between 1500 degrees Kelvin and 10000 degrees Kelvin.

6. The lighting apparatus of claim 5 including a second row of LEDs attached to the holder in parallel with the first row.

7. The lighting apparatus of claim 6 including a gear assembly engaged with the first and second bracket, when the gear assembly moves, the first and second screens rotate about the holder.

8. The lighting apparatus of claim 7 including a stem which extends down from the gear assembly, when the stem is rotated, the stem moves the gear assembly which rotates the first and second screens about the holder.

9. The lighting apparatus of claim 6 including a motor engaged with the gear assembly, when the motor is activated, the motor moves the gear assembly which rotates the first and second screens about the holder.

10. The lighting apparatus of claim 9 wherein the holder has a first slot extending along the length of the holder with the first row of LEDs disposed in the first slot on the first side of the holder emanating light out from the first side, and a second slot extending along the length of the holder with the second row of LEDs disposed in the second slot on the second side of the holder emanating light out from the second side.

11. The lighting apparatus of claim 10 wherein the heat sink includes a plurality of fins disposed above the first and second slots extending along the length of the holder.

12. The lighting apparatus of claim 11 including a third row of LEDs disposed on the first side of the holder above the first row of LEDs emanating light out from the first side which operate at a temperature at least 500 degrees Kelvin different from a temperature at which the first row of LEDs operate.

13. The lighting apparatus of claim 12 wherein the first screen may be opaque, reflective to reflect light from the first row of LEDs, translucent to reflect some light and transmit some light from the first row of LEDs, or transparent to transmit light from the first row of LEDs, or combinations thereof.

14. The lighting apparatus of claim 13 including a first diffuser extending along the length of the holder attached to the holder about the first slot to cover the first row of LEDs through which light from the first row of LEDs is transmitted, and a second diffuser extending along the length of the holder attached to the holder about the second slot to cover the second row of LEDs through which light from the second row of LEDs is transmitted.

15. A method for lighting a building structure comprising the steps of:

moving a first bracket attached to a first screen and moveably attached to a first side of a holder relative to the holder so the first screen is placed into a desired position relative to a first row of LEDs attached to the first side of the holder, the first bracket extends outward from the holder in a first direction on the first side of the holder; and moving a second bracket attached to a second screen and moveably attached to a second side of a holder relative to the holder so the second screen is placed into a desired position relative to a second row of LEDs attached to the second side of the holder, the second bracket extends outward from the holder in a second direction on the second side of the holder, the holder having a heat sink for holding the first row of LEDs and second row of LEDs along a length of the holder and dissipating heat from the LEDs, the holder held by an attachment connected to the holder to the building structure.

* * * * *